United States Patent [19]

Eijkelenboom et al.

[11] Patent Number: 4,855,886

[45] Date of Patent: Aug. 8, 1989

[54] LUMINAIRE HAVING A FACETED REFLECTING SURFACE

[75] Inventors: Leonard C. H. Eijkelenboom; Egbertus J. P. Maassen; Franciscus A. M. M. Van Meel, all of Eindhoven, Netherlands

[73] Assignee: U.S. Philips Corporation, New York, N.Y.

[21] Appl. No.: 128,757

[22] Filed: Dec. 4, 1987

[30] Foreign Application Priority Data

Dec. 4, 1986 [NL] Netherlands ..... 8603089

[51] Int. Cl.[4] ..... F21V 7/00

[52] U.S. Cl. ..... 362/350; 362/217; 362/346; 350/630

[58] Field of Search ..... 362/217, 263, 297, 304, 362/346, 348, 350, 349; 350/616, 628, 630

[56] References Cited

U.S. PATENT DOCUMENTS 4,447,865 5/1984 VanHorn et al. ..... 362/350 X 4,494,176 1/1985 Sands et al. ..... 362/350 X

FOREIGN PATENT DOCUMENTS 2482734 11/1981 France ..... 350/630

523215 7/1940 United Kingdom .

*Primary Examiner*—Stephen F. Husar

*Attorney, Agent, or Firm*—Brian Wieghaus

[57] ABSTRACT

Luminaire provided with a bowl-shaped reflector for an elongated light-emitting part of a light source to be arranged substantially on the principal axis of said reflector. The reflector has a reflecting surface composed of elongated facets whose longitudinal sides extend from adjacent the center to the peripheral edge of the reflector. The facets are concavely curved in a cross-section comprising the principal axis and are straight in a plane at right angles to the peripheral axis and constitute a regular polygon, the axis of symmetry of a facet extending in accordance with a curve approaching the shape of a parabola.

7 Claims, 1 Drawing Sheet

LUMINAIRE HAVING A FACETED REFLECTING SURFACE

BACKGROUND OF THE INVENTION

The invention relates to a luminaire provided with a bowl-shaped reflector for an elongated light-emitting part of a light source to be arranged substantially on the principal axis of said reflector, which reflector has a reflecting surface composed of elongated facets whose longitudinal sides extend from adjacent the center to the peripheral edge of the reflector, said facets being concavely curved in a cross-section comprising the principal axis. A luminaire of this type formed as a reflector is known from British patent specification No. 523,215.

The known luminaire comprises a reflector in which a light source (such as a high-pressure discharge lamp or an incandescent lamp) is arranged. A uniform brightness of an object to be illuminated is obtained with the aid of such a luminaire. The light beam with which this is realized is, however, relatively narrow. The illumination of large objects for which strict requirements are imposed on a uniform brightness either requires voluminous reflectors or the use of a large number of reflectors arranged in proximity to one another. This is a drawback, notably when illuminating objects on display in shop windows and the like.

SUMMARY OF THE INVENTION

It is an object of the invention to provide a comparatively compact luminaire having a reflector with which a relatively broad light beam can be realized and with which an object can be illuminated very evenly.

According to the invention a luminaire of the type described in the opening paragraph is therefore characterized in that the facets are straight in a plane at right angles to the principal axis and the axis of symmetry of each facet extends in accordance with a curve approaching the shape of a parabola. Each facet extends along a portion of a substantially parabolically curved plane which, as used hereinafter, refers to a cylindrical surface whose axis is perpendicular to the principal axis, the directrix for defining the cylindrical surface being a parabola which is coplanar with the principal axis. In cross-sections taken normal to the principal axis, the reflecting surface defines an equilateral and equiangular polygon.

The axis of symmetry of a facet is an imaginary line extending in the longitudinal direction through the center of a facet. It extends in accordance with a curve which has, for example a shape as described in Dutch patent application No. 80 02 116 laid open to public inspection.

Dependent on the number of facets and the extent of curvature of the above-mentioned curves, a remarkably broad light beam can be obtained with the reflector. According to the invention a luminaire having a relatively compact reflector can be used for a large number of different applications and an object illuminated thereby exhibits a very uniform brightness. The reflector is shaped in such a way that light rays are prevented from being reflected on the light-emitting part after reflection. In high-pressure discharge lamps this reflection back onto the light emitting part easily leads to a disturbance of the temperature and the gas pressure in the tubular discharge vessel, and in halogen incandescent lamps it leads to so-called "hot spots" in the filament. The reflector also provides the possibility of modifying the position of the light-emitting part of the light source with respect to the reflecting surface in the axial direction, independently of the application to be selected and without any detrimental effect on the quality of the light beam. The use of a special diffusor on the light exit side of the luminaire is not necessary.

In a luminaire according to the invention the light intensity in the beam evenly decreases to its half value over a cross-section measured from its axis.

In a special embodiment of the luminaire the number of facets is inversely proportional to the width of the elongated light-emitting part of the light source. It has been found that this relationship between the number of facets and the dimensions of the light-emitting part provides the possibility of adjusting the beam width in a simple manner for different applications.

In one embodiment the luminaire comprises a synthetic material housing accommodating the reflector. The housing has for example a wall part which can be fixed in a base in a manner as described in EP-PS 76007 corresponding to U.S. Pat. No. 4,473,864.

BRIEF DESCRIPTION OF THE DRAWINGS

The invention will now be described in greater detail and by way of example, with reference to the accompanying drawing in which.

DESCRIPTION OF THE PREFERRED EMBODIMENT

Figure 1:
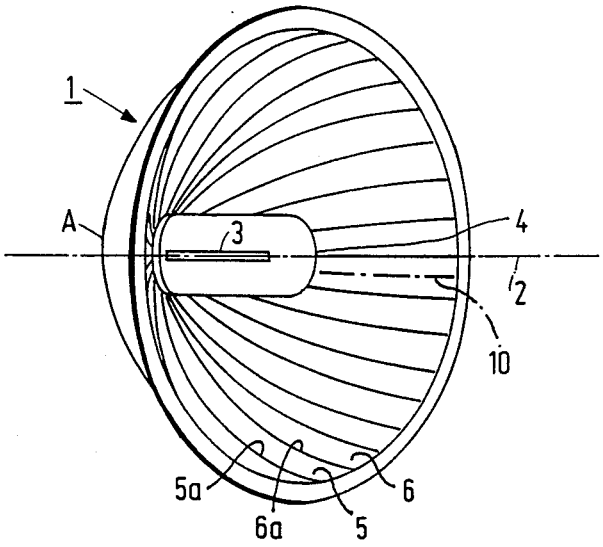
FIG. 1 is a perspective view of an embodiment of a luminaire according to the invention.
Figure 2:
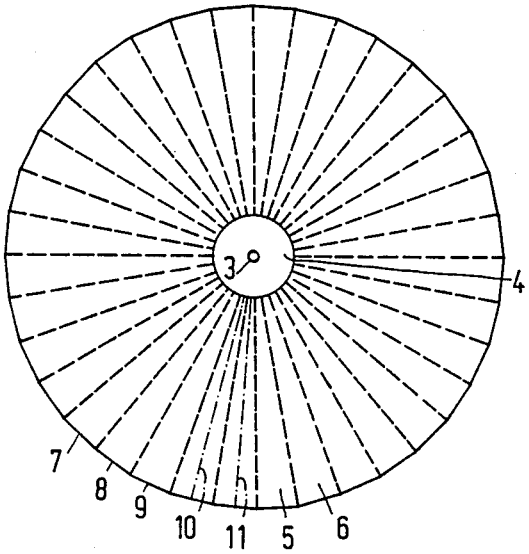
FIG. 2 is an elevational diagrammatic view of the luminaire of FIG. 1 viewed from the light exit side in the direction of the principal axis.

The luminaire of FIG. 1 has a bowl-shaped reflector 1. A hole in which a light source is arranged is provided at the center, hereinafter referred to as the top (A), of the reflector at the area of the principal axis 2. A lamp holder is provided for this purpose. This light source is a high-pressure sodium vapor discharge lamp having a relatively thin, elongated tubular ceramic discharge vessel 3 accommodating the electrodes. A discharge is maintained between the electrodes during operation of the lamp. During lamp operation the discharge vessel thus constitutes the light-emitting part. The discharge vessel 3 is present in an evacuated glass outer envelope 4. The discharge vessel (having a wall consisting of transparent material such as sintered polycrystalline aluminium oxide) is located substantially extending along the principal axis 2. The reflecting surface is composed of elongated facets (such as 5 and 6) whose longitudinal sides (5*a*, 6*a*, etc.) extend from the top to the largest circumference (the light exit side) of the reflector. The facets are straight in planes at right angles to the principal axis 2 at points along substantially their entire length. When viewed end on in these planes, therefore the configuration of facets constitutes a regular polygon. This polygonal configuration is shown by way of example in FIG. 2 by means of the reference numerals 7, 8 and 9. The axes of symmetry of the facets are concavely curved. For two typical single facets the said axis of symmetry is denoted in the drawing by the reference numerals 10 and 11 respectively. The axis constitutes a curve which is specifically calculated (see NL-TV No. 8002116) and tends towards the shape of a parabola. The curve is characterized by coordinates with respect to the principal axis 2 (x-axis) and an axis perpendicular thereto (y-axis). For example the origin (0,0) is the center of the hole in the top of the reflector.

In another embodiment a high-voltage halogen incandescent lamp of, for example approximately 150 W instead of the said high-pressure sodium vapor discharge lamp is arranged in the reflector. Such an incandescant lamp has a filament which is folded in a number of areas. The filament parts are arranged to lie mainly in the direction of the principal axis. The light-emitting part is then elongated, but it is broader than the light-emitting part of the previously mentioned discharge lamp. The number of facets of the associated reflector is then chosen to be smaller in order to obtain a homogeneous light beam. The beam width is further enlarged by reducing the number of facets.

In a particular embodiment the internal diameter of the reflector is 125 mm at its largest circumference. The reflector has 35 facets (thus in a plane at right angles to the principal axis there is a polygon of 35 chords). A high-pressure sodium vapor discharge lamp having a power of 50 W is arranged in the reflector. The external diameter of the tubular discharge vessel is 4.9 mm, the discharge path is approximately 16.5 mm. The axis of symmetry of a facet extends in accordance with a curve which is characterized by X-Y coordinates as shown in the Table below. The values are expressed in mm. The origin (X=0, Y=0) is the center of the hole in the top (A).

TABLE

| X-axis (principal axis) (mm) | Y-axis (mm) |
|---|---|
| 0.00 | 16.00 |
| 2.10 | 19.98 |
| 3.99 | 22.93 |
| 6.04 | 25.76 |
| 8.07 | 28.30 |
| 10.03 | 30.57 |
| 12.06 | 32.78 |
| 14.15 | 34.93 |
| 16.11 | 36.86 |
| 18.11 | 38.75 |
| 20.14 | 40.59 |
| 22.04 | 42.22 |
| 23.98 | 43.80 |
| 25.95 | 45.34 |
| 27.96 | 46.83 |
| 30.00 | 48.27 |
| 32.07 | 49.68 |
| 33.95 | 50.91 |
| 36.06 | 52.24 |
| 37.99 | 53.41 |
| 40.14 | 54.68 |
| 42.10 | 55.79 |
| 44.07 | 56.87 |
| 46.06 | 57.93 |
| 48.05 | 58.97 |
| 50.06 | 59.98 |

TABLE-continued

| X-axis (principal axis) (mm) | Y-axis (mm) |
|---|---|
| 52.08 | 60.97 |
| 54.12 | 61.94 |
| 55.33 | 62.50 |

This Table shows that the hole for accommodating the lamp in the proximity of the top of the reflector has a diameter of 32 mm. The largest diameter is 125 mm which occurs at x=55.33 mm, y=62.5 mm. When placing the light-emitting part of the light source (the tubular discharge vessel) along the principal axis (X-axis) with the center of the discharge vessel being located in the proximity of point (X=15.25, Y=0.00) a beam width of 2×10° is realized.

What is claimed is:

1. A luminaire, comprising:

a light source having an elongated light emitting portion defining a principal axis; and a bowl shaped reflector having an opening for receiving said light source and a reflecting surface defining a focal axis aligned with said principal axis of said light source, said reflecting surface comprising a plurality of contiguous facets each extending from said opening to a peripheral edge of said reflector along a portion of a substantially parabolically curved plane, and for points along substantially the entire axial length of said reflecting surface, the cross-section in planes normal to said principal axis of the reflecting surface of each facet is a straight line, and the straight line cross-sections of said plurality of facets defining an equilateral and equiangular polygon.

2. A luminaire as claimed in claim 1, wherein said light source is an incandescant lamp comprising a filament or filament parts mainly arranged in the direction of the principal axis.

3. A luminaire as claimed in claim 1, wherein said light source is a high-pressure sodium vapor discharge lamp.

4. A luminaire as claimed in claim 1, wherein said elongated light emitting portion of said light source has a width dimension, and the number of facets is inversely proportional to said width dimension.

5. A luminaire as claimed in claim 4, wherein said light source is an incandescent lamp comprising a filament or filament parts mainly arranged in the direction of the principal axis.

6. A luminaire as claimed in claim 4, wherein said light source is a high-pressure sodium vapor discharge lamp.

7. A luminaire as claimed in claim 1, wherein said facets are shaped for preventing light from said light emitting portion of said light source from being reflected onto said light emitting portion.

* * * * *